US005924407A

United States Patent [19]

Iwaszkiewicz et al.

[11] Patent Number: 5,924,407

[45] Date of Patent: Jul. 20, 1999

[54] COMMANDED, RAIL-PRESSURE-BASED, VARIABLE INJECTOR BOOST CURRENT DURATION

[75] Inventors: Titus J. Iwaszkiewicz, Woodridge; David V. Rodgers, Villa Park, both of Ill.

[73] Assignee: Navistar International Transportation Corp., Chicago, Ill.

[21] Appl. No.: 09/124,279

[22] Filed: Jul. 29, 1998

[51] Int. Cl.[6] ..... F02M 7/00

[52] U.S. Cl. ..... 123/446; 123/458; 123/41.31; 251/129.22

[58] Field of Search ..... 123/458, 41.31, 123/446, 447; 251/129.09, 129.1, 129.15, 129.22

[56] References Cited

U.S. PATENT DOCUMENTS

| | | | |
|---|---|---|---|
| 4,342,443 | 8/1982 | Wakeman | 251/129.09 |
| 4,785,787 | 11/1988 | Risk | 123/458 |
| 4,948,093 | 8/1990 | Sugawara | 251/129.09 |
| 5,069,186 | 12/1991 | Illien | 251/129.09 |
| 5,181,494 | 1/1993 | Ausman et al. . | |
| 5,357,912 | 10/1994 | Barnes et al. . | |
| 5,485,820 | 1/1996 | Iwaszkiewicz | 123/458 |
| 5,623,960 | 4/1997 | Kawamura | 251/129.22 |
| 5,628,296 | 5/1997 | Herrington | 251/129.15 |
| 5,720,261 | 2/1998 | Sturman | 123/446 |
| 5,720,262 | 2/1998 | Antonioli | 123/458 |
| 5,775,279 | 7/1998 | Moriya | 251/129.1 |
| 5,839,412 | 11/1998 | Stockner | 123/446 |

OTHER PUBLICATIONS

"HEUI Fuel System Operation", Brochure CGE 472–1, Navistar International Transportation Corp., Feb. 1995.

*Primary Examiner*—Carl S. Miller
*Attorney, Agent, or Firm*—Dennis Kelly Sullivan; Jeffrey P. Calfa

[57] ABSTRACT

An electric control for a fuel injector develops a commanded boost signal that is superimposed on a fuel injection pulse waveform. Variable operating parameters, such as engine speed, fuel injection quantity, engine coolant temperature, and engine air intake temperature are monitored and may diminish the duration of the commanded boost signal under certain conditions to avoid overheating electric circuit elements in the control through which electric power is delivered to the fuel injector.

29 Claims, 5 Drawing Sheets

COMMANDED, RAIL-PRESSURE-BASED, VARIABLE INJECTOR BOOST CURRENT DURATION

FIELD OF THE INVENTION

This invention relates generally to an internal combustion engine fuel system having electrically controlled fuel injectors. More particularly the invention relates to an improvement in an electric control for a fuel injector that establishes the duration for which a boost signal is allowed to be superimposed on a fuel injection signal to a fuel injector. The invention is especially, although not exclusively, useful in the fuel systems of certain diesel engines that power automotive vehicles.

BACKGROUND AND SUMMARY OF THE INVENTION

Certain diesel engines have fuel systems that employ electrically-controlled, hydraulically-activated fuel injectors. Oil that is used as the hydraulic activating fluid for the fuel injectors is supplied under pressure to an oil supply port of each fuel injector. Fuel is supplied to a fuel supply port of each injector. The fuel injector comprises a solenoid that, when energized, causes a fuel charge within the injector body to be injected into an engine cylinder by stroking an intensifier piston within the fuel injector. During an injection of fuel, the solenoid operates a poppet valve within the fuel injector body to communicate the head of the intensifier piston to the pressurized oil. The oil pressure applied to the piston head extends the piston to inject the fuel. When the solenoid is de-energized, the fuel injector is re-charged with fresh fuel as an internal spring retracts the intensifier piston.

A pump whose outlet pressure is regulated by a rail pressure control valve pressurizes the oil that activates the intensifier pistons of the fuel injectors to a controlled rail pressure. Controlling the rail pressure controls the fuel injections from the fuel injectors. The fuel injections are also controlled by controlling the electric current waveforms that energize the fuel injector solenoids.

Increasing the rail pressure may be desirable at certain times for certain reasons. For some emission control purposes, it may be desirable under some circumstances to increase the pressure at which fuel is injected from the fuel injectors. However, because the rail pressure acts on internal mechanisms of the fuel injectors, an increase in the rail pressure may interact with the control relationship between a fuel injector solenoid and its injection mechanism such that an electric current characteristic that produces a certain injector response at a certain rail pressure may not produce the same response at a different rail pressure. Accordingly, it may be appropriate to alter the electric current waveform in a manner that compensates for the effect of changes in rail pressure.

One form that such compensation may take is sometimes referred to as current boost, or simply boost. During an injection of fuel from a fuel injector, boost may be introduced into an electric current waveform that is applied to a fuel injector solenoid. This introduction may comprise increasing the magnitude of the electric current waveform over a portion of the time duration of the waveform. However, increasing the electric current flow to a fuel injector solenoid inherently increases the power flow through electric circuit elements in the electric control that operates the fuel injector. The increased power flow through such circuit elements results in increased power dissipation in them, such power dissipation manifesting itself as heat.

Because certain electric circuit elements, such as semiconductors, may be adversely affected by excessive heat, and consequently, increased electric power flow to a fuel injector may be detrimental to the electric control that operates the fuel injectors. Accordingly, special measures may have to be invoked for dissipating the added thermal energy input to the control, such as associating heat sinks with electric circuit components and/or their mountings, and or/ utilizing circuit elements that have higher power ratings. Such solutions are apt to introduce added cost and complexity into a design.

The present invention relates to an improvement that provides a different solution that is believed preferable to those just mentioned. The inventive solution can avoid cost and complexity issues that may be associated with alternative solutions. Briefly, the solution that is embodied in the present invention involves the creation of a combination of selected signal sources that is organized and arranged to control the extent to which a boost signal is allowed to be superimposed on a fuel injection signal waveform applied to a fuel injector. These signal sources include certain variable parameters related to engine operation. Full boost is allowed under sets of conditions where electric circuit elements can tolerate full boost current. Lesser boost is allowed as operating parameters vary in ways that suggest that electric circuit elements are becoming less tolerant.

Several aspects of the invention share the common subject matter of a control for operating an internal combustion engine fuel injector comprising: an injection signal source supplying an injection signal for causing a fuel injector to inject fuel into an engine; a commanded boost signal source supplying a commanded boost signal; and an interface for superimposing the commanded boost signal on the injection signal during a phase of the injection signal.

According to one general aspect of the invention that shares this common subject matter, the commanded boost signal source comprises an is adjusted boost signal source supplying an adjusted boost signal, and the adjusted boost signal source comprises a base boost signal source supplying a base boost signal representing a base boost for the injection signal and a temperature signal source supplying a temperature signal correlated to temperature of an engine operating parameter. The adjusted boost signal is determined both by the base boost signal and by the temperature signal, and the commanded boost signal is determined by the adjusted boost signal.

According to another general aspect that shares the above-mentioned common subject matter, the commanded boost signal source comprises an adjusted boost signal source supplying an adjusted boost signal and a requested boost signal source supplying a requested boost signal. The adjusted boost signal source comprises a base boost signal source supplying a base boost signal representing a base boost for the injection signal, an operating parameter signal source supplying an operating parameter signal correlated to a variable engine operating parameter, and a comparator. The adjusted boost signal is determined both by the base boost signal and by the operating parameter signal, and the comparator determines the commanded boost signal from one of the adjusted boost signal and the requested boost signal to the exclusion of the other.

According to another general aspect that shares the above-mentioned common subject matter, the commanded boost signal source comprises an adjusted boost signal source supplying an adjusted boost signal, and the adjusted boost signal source comprises a base boost signal source supplying a base boost signal representing a base boost for the injection signal and an operating parameter signal source supplying an operating parameter signal correlated to a variable engine operating parameter. The base boost signal source comprises a fuel delivery control signal source supplying a fuel delivery control signal correlated to an amount of fuel to be injected during a fuel injection. The commanded boost signal is determined by the adjusted boost signal, the adjusted boost signal is determined both by the base boost signal and by the operating parameter signal, and the base boost signal is determined by the fuel delivery control signal.

According to another general aspect that shares the above-mentioned common subject matter, the commanded boost signal source comprises an adjusted boost signal source supplying an adjusted boost signal, and the adjusted boost signal source comprises a base boost signal source supplying a base boost signal representing a base boost for the injection signal and an operating parameter signal source supplying an operating parameter signal correlated to a variable engine operating parameter. The base boost signal source comprises an engine speed signal source supplying a speed signal correlated to engine speed. The commanded boost signal is determined by the adjusted boost signal, the adjusted boost signal is determined both by the base boost signal and by the operating parameter signal, and the base boost signal is determined by the engine speed signal.

Still another aspect of the invention relates to an internal combustion engine fuel system comprising: electrically-controlled, hydraulically-activated fuel injectors for injecting fuel into engine cylinders and an electric control for causing hydraulic activation of the fuel injectors to inject fuel into the cylinders. The electric control comprises an injection signal source supplying injection signals to the fuel injectors to cause the fuel injectors to be hydraulically activated, a commanded boost signal source supplying commanded boost signals, and an interface for superimposing the commanded boost signals on the injection signals during phases of the injection signals. The commanded boost signal source comprises an adjusted boost signal source supplying adjusted boost signals, and the adjusted boost signal source comprises a base boost signal source supplying base boost signals representing boost for the injection signals and an operating parameter signal source supplying an operating parameter signal correlated to a variable engine operating parameter. The adjusted boost signals are determined both by the base boost signals and by the operating parameter signal, and the commanded boost signals are determined by the adjusted boost signals.

Still another inventive aspect relates to a method of operating an internal combustion engine fuel injector comprising: creating, in an electric control, a fuel injection signal providing electric power flow to a fuel injector; supplying a commanded boost signal; superimposing the commanded boost signal on the fuel injection signal during a phase of the injection signal to augment the electric power flow to the fuel injector; and attenuating the duration of the commanded boost signal as a function of a variable parameter that is indicative of decreased tolerance of the electric control to increased electric power flow to the fuel injector.

The foregoing, along with further aspects, features, and advantages of the invention, will be seen in this disclosure of a presently preferred embodiment of the invention depicting the best mode contemplated at this time for carrying out the invention. This specification includes drawings, first briefly described below and followed by detailed description.

DESCRIPTION OF THE PREFERRED EMBODIMENT

Figure 1:
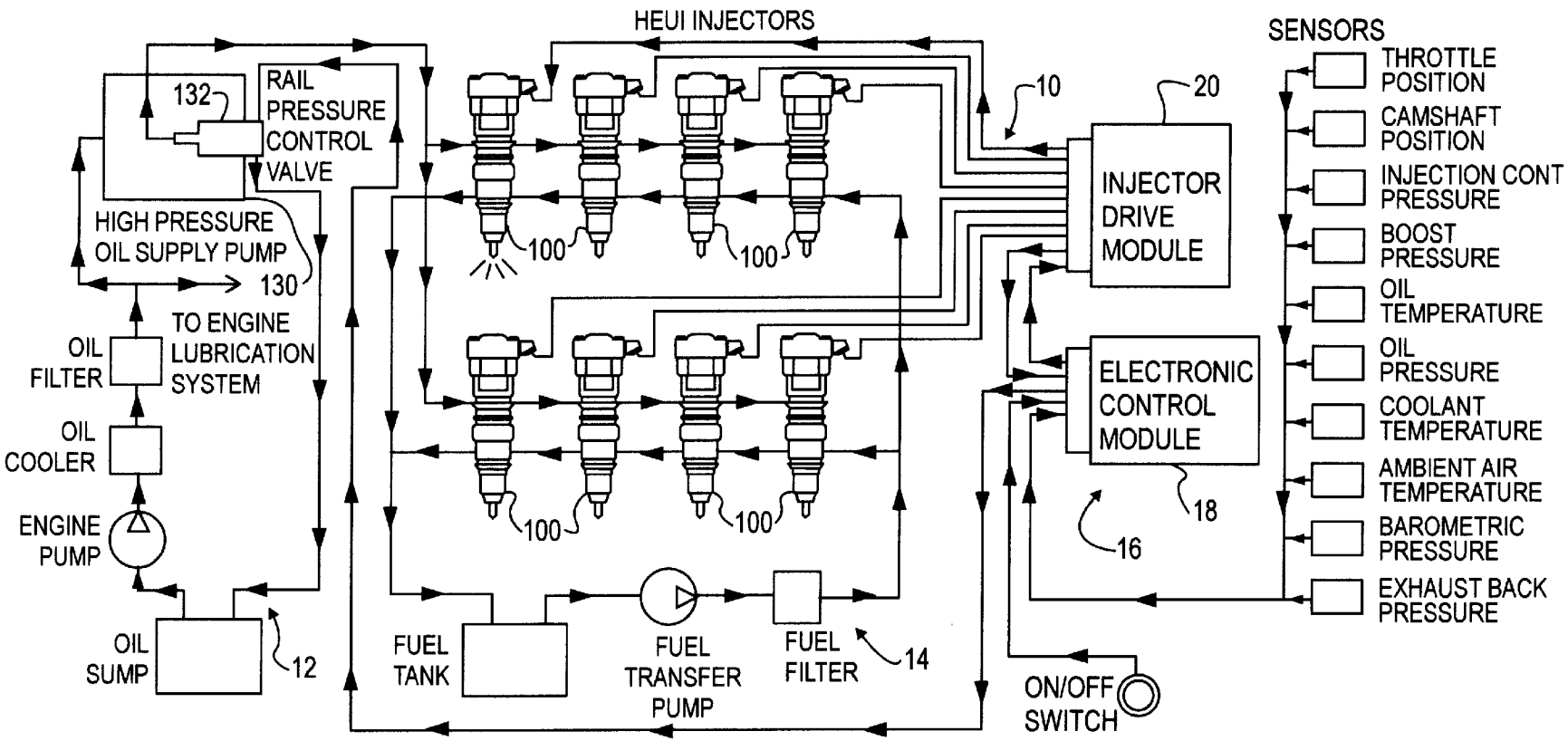
FIG. 1 is a schematic diagram of an exemplary fuel management system of an internal combustion engine with which the present invention is especially useful.

FIG. 1 shows an exemplary fuel injection system 10 for an internal combustion engine, specifically an eight-cylinder diesel engine. The system comprises a number of fuel injectors 100 each of which injects fuel into a respective engine cylinder. The system includes an oil supply circuit 12 that supplies pressurized oil to fuel injectors 100, and a fuel supply circuit 14 that supplies pressurized fuel. An electric control 16 comprises an electronic control module, or ECM, 18 and an injector drive module 20. ECM 18 receives various input signals, such as those shown, and performs processing to develop signals for operating fuel injectors 100 in proper manner via injector drive module 20 to cause fuel to be injected into each engine cylinder in proper amount and at proper time in the engine cycle for operating the engine.

Figure 2:
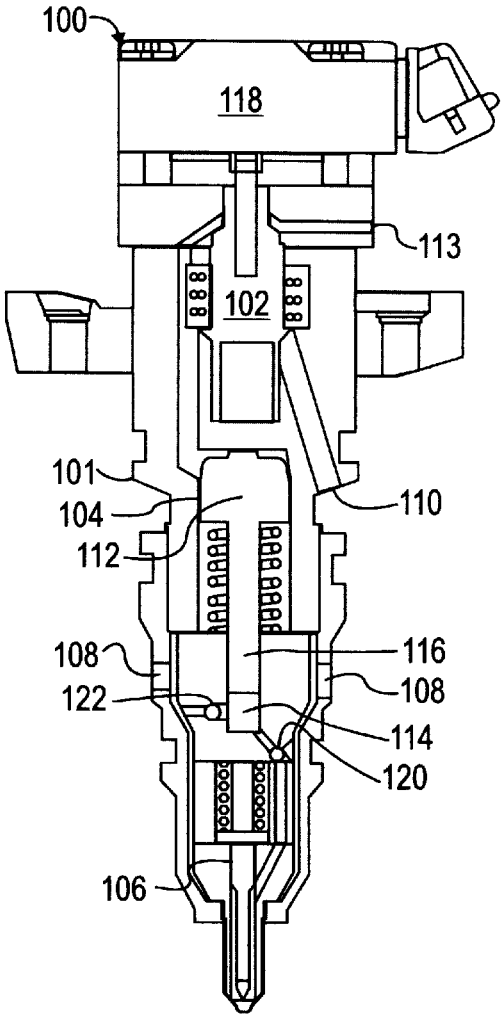
FIG. 2 is a longitudinal cross section view of an electrically-controlled, hydraulically-activated fuel injector of the engine fuel management system of FIG. 1, showing the fuel injector just before the beginning of a fuel injection.
Figure 3:
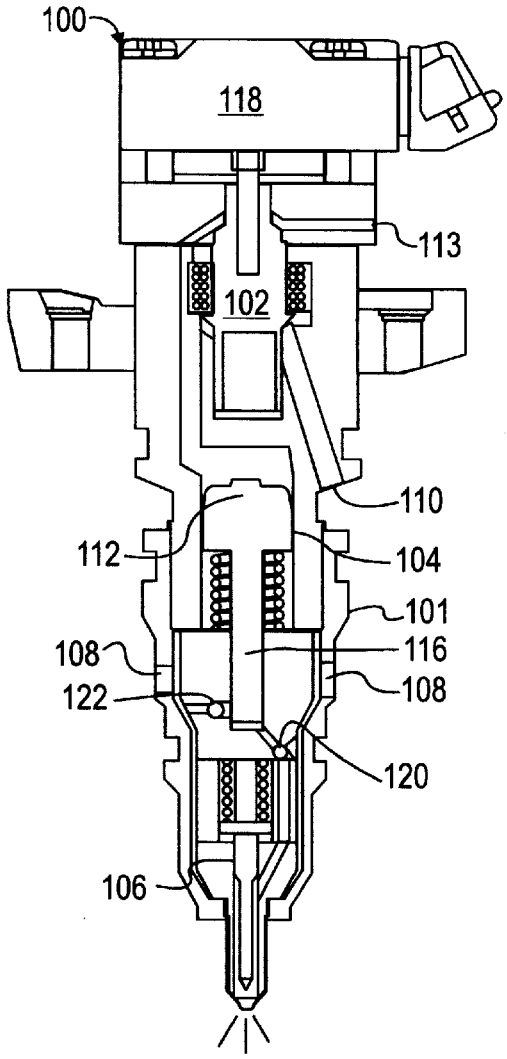
FIG. 3 is view like FIG. 2, but showing the fuel injector at the conclusion of an injection.

Detail of a fuel injector 100 is shown in FIG. 2, which illustrates a condition just prior to the beginning of an injection, and FIG. 3, which illustrates a condition at the conclusion of an injection. Fuel injector 100 comprises an injector body 101 containing a spring-biased poppet valve 102, a spring-biased intensifier piston 104, and a spring-biased nozzle valve 106. Pressurized fuel from fuel supply circuit 14 is delivered to a fuel supply port 108 in body 101, and pressurized oil from oil supply circuit 12, to an oil supply port 110. FIG. 2 shows a spring bias force acting on poppet valve 102 is causing the poppet valve to block the head 112 of intensifier piston 104 from the pressurized oil at oil supply port 110, but at the same time open a drain port 113. In this condition, valve 106 is spring-biased closed, and intensifier piston 104 is spring-biased at a position where it is poised to inject into the respective engine cylinder, a charge of liquid fuel that it had previously drawn from fuel supply port 108 to fill a cylinder space 114 below the intensifier piston plunger 116. Nozzle valve 106 remains closed until intensifier piston 104 acts on the charge of fuel in cylinder space 114.

Fuel injector 100 further comprises a solenoid 118 that operates poppet valve 102 to cause a fuel injection. Energization of solenoid 118 by electric current from injector drive module 20 overcomes the spring-bias force acting on poppet valve 102, causing the poppet valve to move to a new position that allows pressurized oil from oil supply circuit 12 to act on intensifier piston head 112 and concurrently closes drain port 113. The applied oil pressure is amplified by intensifier piston 104, with the amplified pressure being hydraulically transmitted through the liquid fuel in body 101 to unseat a check valve 120 in a passage between cylinder space 114 and to open nozzle valve 106. With valves 120 and 106 now open, the oil pressure acting on head 112 displaces piston 104 axially within injector body 101 from the position of FIG. 2 to the position of FIG. 3. Plunger 116 acts on the fuel charge in cylinder space 114 to force fuel from that space, through check valve 120, and out of body 101 through nozzle valve 106 and into the engine cylinder. An injection ends by terminating electric current flow to solenoid 118, or alternatively by the axial travel of piston 104 bottoming out within injector body 101.

When the energization of solenoid 118 ceases, poppet valve 102 returns to its spring-biased position, closing oil supply port 110 and opening drain port 113. Oil pressure ceases to act on piston head 112, and so valves 120 and 106 cease to be forced open. Oil trapped within injector body 101 between piston head 112 and poppet valve 102 now drains out of the injector body through drain port 113 as the spring-bias acting on piston 104 returns the piston in the opposite axial direction back toward the FIG. 2 position, increasing the volume of cylinder space 114 in the process. The increasing volume of cylinder space 114 unseats another check valve 122 that had been closed during the injection, allowing fuel to pass from fuel supply circuit 14 through fuel supply port 108 and the unseated check valve 122 to re-charge cylinder space 114. When piston 104 has been displaced to the FIG. 2 position, the re-charging is complete, and check valve 122 closes.

The pressure of the oil that is supplied to port 110 is developed by a pump 130 whose outlet pressure is regulated by a rail pressure control valve 132 to a controlled rail pressure applied to all fuel injectors. Controlling the rail pressure controls the fuel injections from the injectors. The fuel injections are also controlled by controlling the electric current that energizes solenoids 118.

Increasing the rail pressure may be desirable at certain times in certain engines for certain reasons. For example, for emission control purposes, it may be desirable under certain circumstances to increase the pressure at which fuel is injected from injectors 100 when their solenoids 118 are energized. However, because the rail pressure acts on internal mechanism of a fuel injector 100, increase in the rail pressure may interact with the control relationship between the solenoid and the injector mechanism such that an electric current characteristic that produces a certain injector response at a certain rail pressure may not produce the same response at a different rail pressure. Accordingly, it may be appropriate to change the electric current characteristic in a manner that compensates for the effect of changes in rail pressure.

Figure 4:
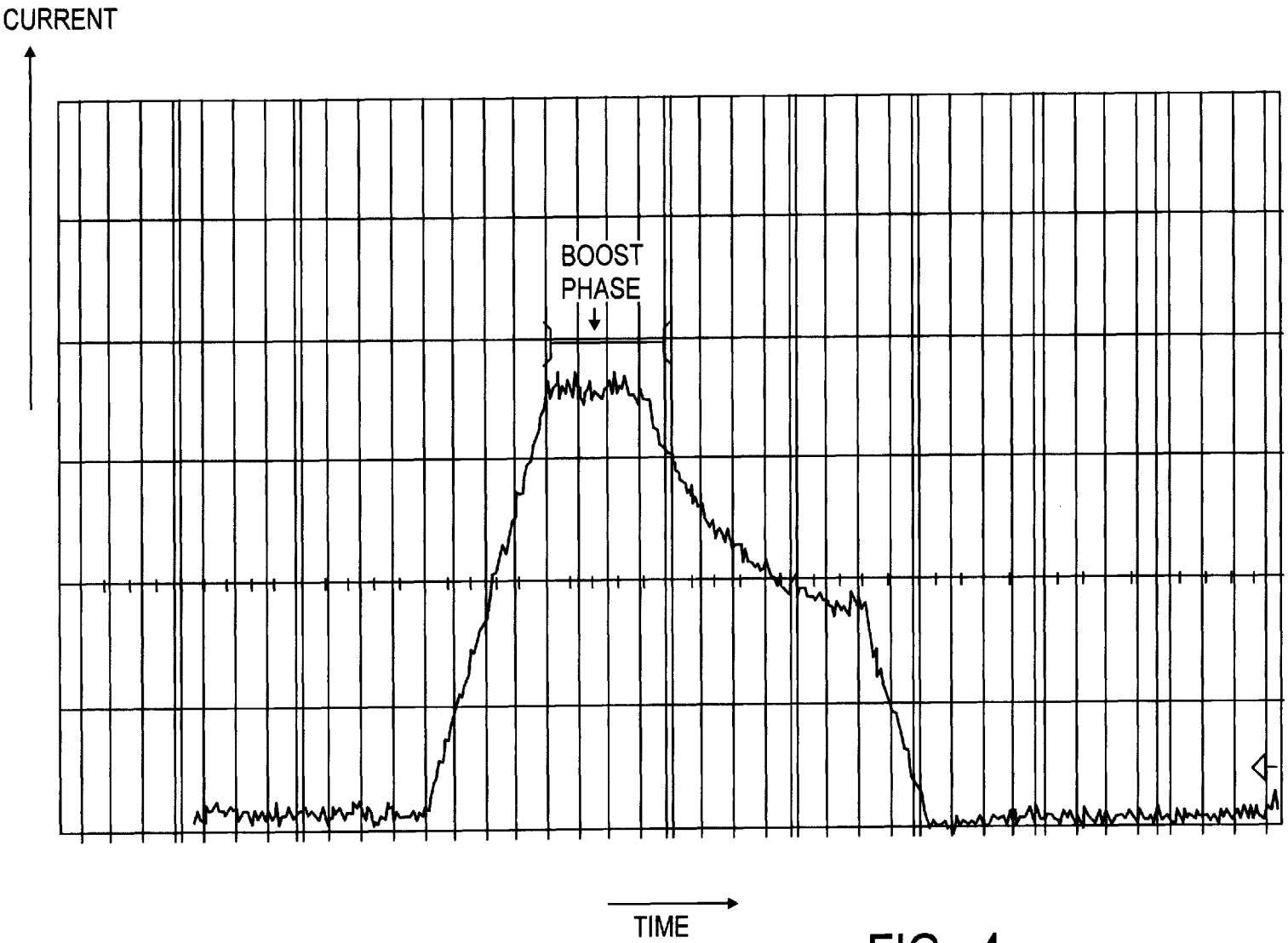
FIG. 4 is an electric signal waveform useful in understanding the disclosure.

One form that such compensation may take is sometimes referred to as current boost, or simply boost. During an injection of fuel, boost may be introduced into an electric current waveform that is being applied to a fuel injector solenoid. Such boost may comprise increasing the magnitude of the electric current during a boost phase occurring over a portion of the time span of the electric current waveform. FIG. 4 shows an exemplary injection current waveform that includes a boost phase.

The electric current for operating each fuel injector 100 is delivered from injector drive module 20 under the control of a corresponding electric signal from ECM 18 to module 20. Increasing the electric current flow to a fuel injector inherently increases the power flow through electric control 16. The increased power flow increases the power loss in electric control 16, with such power loss appearing as heat. Electric control circuit elements, such as semiconductors, may be adversely affected by heat, and consequently, increasing the electric power flow to a fuel injector may harm the control circuit.

Figure 5:
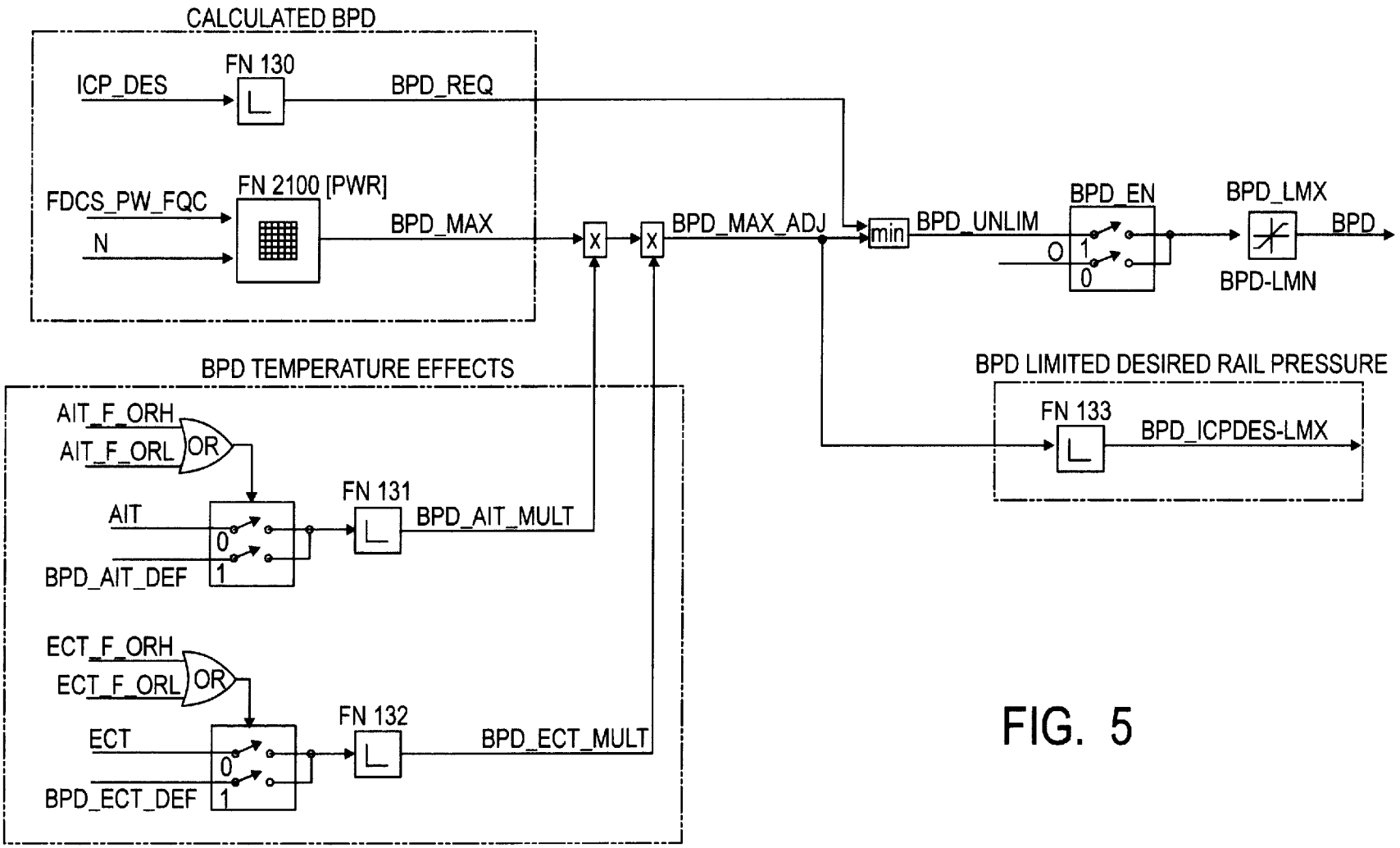
FIG. 5 is a schematic diagram of an exemplary implementation of the invention.

FIG. 5 shows a schematic diagram of an exemplary implementation of the inventive solution. Although the invention can be embodied in both hardware and software implementations, the diagram presented discloses a microprocessor implementation because contemporary electrically controlled, fuel injection systems are typically microprocessor-based, as is control 16. A commanded boost signal BPD is supplied by a commanded boost signal source. The commanded boost signal source comprises an adjusted boost signal source that supplies an adjusted boost signal BPD_MAX_ADJ and a requested boost signal source that supplies a requested boost signal BPD_REQ.

The adjusted boost signal source comprises a base boost signal source that supplies a base boost signal BPD_MAX; it also comprises operating parameter signal sources. One operating parameter signal source is an engine intake air temperature signal source that supplies an engine intake air temperature signal BPD_AIT_MULT. Another operating parameter signal source is an engine coolant temperature signal source that supplies an engine coolant temperature signal BPD_ECT_MULT.

The engine intake air temperature signal source obtains engine intake air temperature data from a data link on which engine intake air temperature data is published. The seminal source of this data may be a sensor disposed in a suitable location on or proximate the engine. The published data signal is designated AIT.

The engine coolant temperature signal source obtains engine coolant temperature data from a data link on which engine coolant temperature data is published. The seminal source of this data may be a sensor disposed in a suitable location on or proximate the engine; a sensor mounted on the engine block at a coolant passage through which liquid coolant is circulated. The published data signal is designated ECT.

In order to assure reasonable integrity of both published data signals, i.e. typically to guard against a failed sensor and/or connection, the published data is compared against respective, pre-established upper and lower limits, AIT_F_ORH and AIT_F_ORL in the case of signal AIT, and ECT_F_ORH and ECT_F_ORL in the case of signal ECT. So long as each data signal is within the respective limits, it is utilized in the inventive solution. If either data signal is out of limits, a default value is utilized instead for the data signal.

The engine intake air temperature signal source further includes processing of the utilized data signal by a function generator FN131. This function generator applies a multiplication, or scaling, factor to the utilized data signal to create the signal BPD_AIT_MULT. Likewise, the engine coolant temperature signal source further includes processing of the utilized data signal by a function generator FN132. This function generator also applies a multiplication, or scaling, factor to the utilized data signal to create the signal BPD_ECT_MULT. Each of the scaled data signals BPD_AIT_MULT and BPD_ECT_MULT is thereafter utilized in the creation of the adjusted boost signal BPD_MAX_ADJ.

The base boost signal source includes a function generator FN2100[PWR]. This function generator utilizes two inputs, and may be considered as a look-up table. The two inputs are a speed signal N that represents engine speed and a fuel delivery control signal FDCS_PW_FQC that corresponds to an amount of fuel that is to be injected by a fuel injector. These signals are data-link-published and obtained from respective sources, such as a speed sensor in the case of the engine speed signal, and ECM 18 in the case of the fuel delivery control signal. Function generator FN2100[PWR] establishes a value for the base boost signal that is suitable for the particular amount of fuel that ECM 18 is commanding for each injection and the particular engine speed, assuming that certain variable operating parameters associated with operation of the engine exist. It is because such parameters vary that signals BPD_AIT_MULT and BPD_ECT_MULT are utilized in the inventive solution.

FIG. 5 shows that the signal BPD_MAX_ADJ is created by successively multiplications of the signal BPD_MAX by the signals BPD_AIT_MULT and BPD_ECT_MULT. Signal BPD_MAX specifies a certain duration of time for which boost should ostensibly be superimposed on the fuel injection signal applied to a fuel injector, consistent with measured engine speed and amount of fuel being injected. However, the presence of certain operating conditions, such as increased temperature, call for lessening that duration, and it is for this reason that elevated engine air intake and engine coolant temperatures will cause the BPD_MAX_ADJ signal to have a value less than the BPD_MAX signal. It is to be appreciated that the specific multiplication factors for a particular engine are determined empirically for that engine design.

It is also to be observed that certain changes in engine speed and/or fuel injection quantity will inherently change the value of the BPD_MAX signal even when BPD_AIT_MULT and BPD_ECT_MULT are not causing signal BPD_MAX_ADJ to be different from signal BRD_MAX. Hence, it is to be further appreciated that the particular design characteristic for function generator FN2100[PWR] will also depend on the particular engine involved.

The commanded boost signal source further comprises a comparator MIN that compares signal BPD_MAX_ADJ with signal BPD_REQ. The comparator passes whichever one of the two signals has the lower value. The passed signal is designated BPD_UNLIM. The requested boost signal source comprises a function generator FN133 that acts on a signal ICP_DES. Signal ICP_DES is a signal obtained from ECM 116, and represents desired rail pressure that is applied to all fuel injector oil supply ports 110. Function generator FN133 provides values of requested boost signal BPD_REQ correlated with values of rail pressures. It is signal BPD_REQ that will be passed by comparator MIN, except when engine speed, injected fuel quantity, engine air intake temperature, and/or engine coolant temperature cause signal BPD_MAX_ADJ to have a lower value that calls for a shorter duration boost to be superimposed a fuel injection pulse waveform.

In order for boost to be superimposed on a fuel injection pulse waveform, the strategy provided must be enabled by the engine control. This is performed by a switch at the comparator output that is open when a signal BPD_EN is not enabling the strategy and that is closed when the signal BPD_EN is enabling the strategy.

The commanded boost signal source concludes with a limiter that limits the signal passed by comparator MIN to a value between a maximum value BPD_LMX, corresponding to a maximum duration, and a minimum value BPD_LMN, corresponding to a minimum duration. As long as limiting is not occurring, the commanded boost signal BPD is equal to signal BPD_UNLIM. If limiting is occurring, then the commanded boost signal BPD is equal to signal BPD_LMX in the case of maximum limiting, and to signal BPD_LMN in the case of minimum limiting.

In order to prevent ECM 18 from continuously calling for a desired rail pressure that results in too long a duration for the commanded boost signal under prevailing operating conditions, a maximum limit for desired rail pressure is calculated. This is performed by a function generator FN133 that utilizes signal BPD_MAX_ADJ as an input. The resulting output is a signal $BPD__{ICPDES13}$ LMX. If the engine control is enabling the strategy, then the signal BPD_ICPDES_LMX is used as signal ICF_DES.

Figure 6:
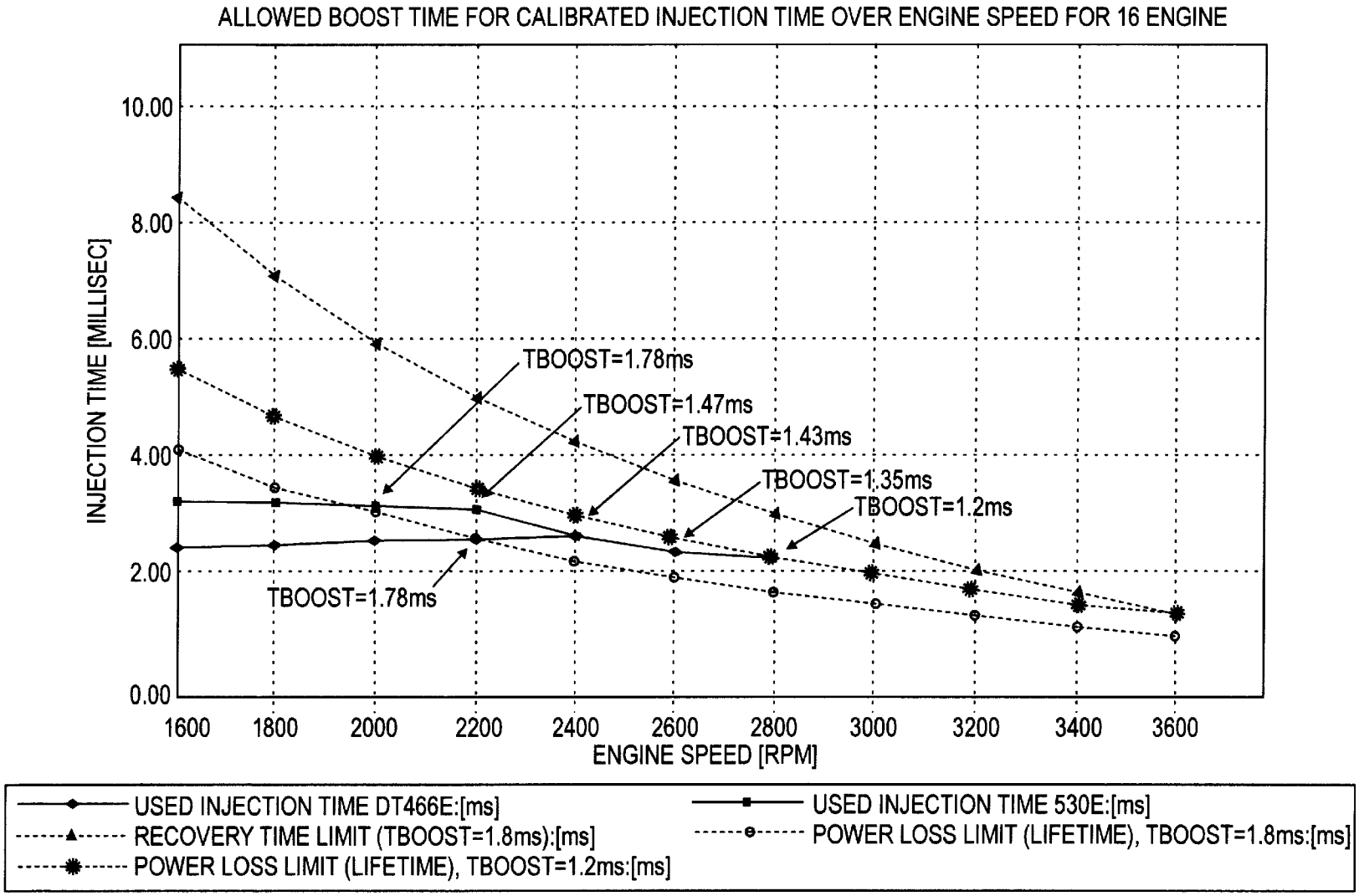
FIG. 6 is an exemplary graph plot useful in understanding an implementation of the invention.

FIG. 6 is a graph plot used in developing allowable boost times for a particular engine.

While a presently preferred embodiment of the invention has been illustrated and described, it should be appreciated that principles of the invention are applicable to all embodiments and uses that fall within the scope of the following claims.

What is claimed is:

1. A control for operating an internal combustion engine fuel injector comprising:

an injection signal source supplying an injection signal for causing a fuel injector to inject fuel into an engine;

a commanded boost signal source supplying a commanded boost signal; and an interface for superimposing the commanded boost signal on the injection signal during a phase of the injection signal;

in which the commanded boost signal source comprises an adjusted boost signal source supplying an adjusted boost signal;

in which the adjusted boost signal source comprises a base boost signal source supplying a base boost signal representing a base boost for the injection signal and a temperature signal source supplying a temperature signal correlated to temperature of an engine operating parameter;

in which the adjusted boost signal is determined both by the base boost signal and by the temperature signal and in which the commanded boost signal is determined by the adjusted boost signal.

2. A control as set forth in claim 1 in which the temperature signal source supplying a temperature signal correlated to temperature of an engine operating parameter comprises an engine intake air temperature source supplying an engine intake air temperature signal corresponding to engine intake air temperature, and the adjusted boost signal is determined both by the base boost signal and by the engine intake air temperature signal.

3. A control as set forth in claim 1 in which the temperature signal source supplying a temperature signal correlated to temperature of an engine operating parameter comprises an engine coolant temperature source supplying an engine coolant temperature signal corresponding to engine coolant temperature, and the adjusted boost signal is determined both by the base boost signal and by the engine coolant temperature signal.

4. A control as set forth in claim 1 in which the temperature signal source supplying a temperature signal correlated to temperature of an engine operating parameter comprises both an engine intake air temperature source supplying an engine intake air temperature signal corresponding to engine intake air temperature and an engine coolant temperature source supplying an engine coolant temperature signal corresponding to engine coolant temperature, and the adjusted boost signal is determined by all of the base boost signal, the engine intake air temperature signal, and the engine coolant temperature signal.

5. A control as set forth in claim 4 in which the base boost signal source comprises a fuel delivery control signal source supplying a fuel delivery control signal correlated to an amount of fuel to be injected during a fuel injection, and in which the base boost signal is determined by the fuel delivery control signal.

6. A control as set forth in claim 5 in which the base boost signal source further comprises an engine speed signal source supplying a speed signal correlated to engine speed, and in which the base boost signal is determined by the speed signal.

7. A control as set forth in claim 4 in which the base boost signal source comprises an engine speed signal source supplying a speed signal correlated to engine speed, and in which the base boost signal is determined by the speed signal.

8. A control as set forth in claim 1 in which the base boost signal source comprises a fuel delivery control signal source supplying a fuel delivery control signal correlated to an amount of fuel to be injected during a fuel injection, and in which the base boost signal is determined by the fuel delivery control signal.

9. A control as set forth in claim 8 in which the base boost signal source further comprises an engine speed signal source supplying a speed signal correlated to engine speed, and in which the base boost signal is determined by the speed signal.

10. A control as set forth in claim 1 in which the base boost signal source comprises an engine speed signal source supplying a speed signal correlated to engine speed, and in which the base boost signal is determined by the speed signal.

11. A control as set forth in claim 1 in which the commanded boost signal source further includes a requested boost signal source supplying a requested boost signal and a comparator that determines the commanded boost signal from one of the adjusted boost signal and the requested boost signal to the exclusion of the other.

12. A control as set forth in claim 11 in which the comparator determines the commanded boost signal from the smaller-valued one of the adjusted boost signal and the requested boost signal.

13. A control as set forth in claim 12 in which the commanded boost signal source comprises a limiter that limits the commanded boost signal to a range between a defined maximum and a defined minimum.

14. A control as set forth in claim 11 in which the requested boost signal source comprises an injection control pressure source supplying an injection control pressure signal correlated to pressure at which fuel is injected from the fuel injector, and in which the requested boost signal is determined by the injection pressure control signal.

15. A control for operating an internal combustion engine fuel injector comprising:

an injection signal source supplying an injection signal for causing a fuel injector to inject fuel into an engine;

a commanded boost signal source supplying a commanded boost signal; and an interface for superimposing the commanded boost signal on the injection signal during a phase of the injection signal;

in which the commanded boost signal source comprises an adjusted boost signal source supplying an adjusted boost signal and a requested boost signal source supplying a requested boost signal;

in which the adjusted boost signal source comprises a base boost signal source supplying a base boost signal representing a base boost for the injection signal, an operating parameter signal source supplying an operating parameter signal correlated to a variable engine operating parameter, and a comparator;

in which the adjusted boost signal is determined both by the base boost signal and by the operating parameter signal; and in which the comparator determines the commanded boost signal from one of the adjusted boost signal and the requested boost signal to the exclusion of the other.

16. A control as set forth in claim 15 in which the comparator determines the commanded boost signal from the smaller-valued one of the adjusted boost signal and the requested boost signal.

17. A control as set forth in claim 16 in which the commanded boost signal source comprises a limiter that limits the commanded boost signal to a range between a defined maximum and a defined minimum.

18. A control as set forth in claim 15 in which the requested boost signal source comprises an injection control pressure source supplying an injection control pressure signal correlated to pressure at which fuel is injected from the fuel injector, and in which the requested boost signal is determined by the injection pressure control signal.

19. A control for operating an internal combustion engine fuel injector comprising:

an injection signal source supplying an injection signal for causing a fuel injector to inject fuel into an engine;

a commanded boost signal source supplying a commanded boost signal; and an interface for superimposing the commanded boost signal on the injection signal during a phase of the injection signal;

in which the commanded boost signal source comprises an adjusted boost signal source supplying an adjusted boost signal;

in which the adjusted boost signal source comprises a base boost signal source supplying a base boost signal representing a base boost for the injection signal and an operating parameter signal source supplying an operating parameter signal correlated to a variable engine operating parameter;

in which the base boost signal source comprises a fuel delivery control signal source supplying a fuel delivery control signal correlated to an amount of fuel to be injected during a fuel injection;

in which the commanded boost signal is determined by the adjusted boost signal;

in which the adjusted boost signal is determined both by the base boost signal and by the operating parameter signal; and in which the base boost signal is determined by the fuel delivery control signal.

20. A control as set forth in claim 19 in which the base boost signal source further comprises an engine speed signal source supplying a speed signal correlated to engine speed, and in which the base boost signal is determined by the speed signal.

21. A control for operating an internal combustion engine fuel injector comprising:

an injection signal source supplying an injection signal for causing a fuel injector to inject fuel into an engine;

a commanded boost signal source supplying a commanded boost signal; and an interface for superimposing the commanded boost signal on the injection signal during a phase of the injection signal;

in which the commanded boost signal source comprises an adjusted boost signal source supplying an adjusted boost signal;

in which the adjusted boost signal source comprises a base boost signal source supplying a base boost signal representing a base boost for the injection signal and an operating parameter signal source supplying an operating parameter signal correlated to a variable engine operating parameter;

in which the base boost signal source comprises an engine speed signal source supplying a speed signal correlated to engine speed;

in which the commanded boost signal is determined by the adjusted boost signal;

in which the adjusted boost signal is determined both by the base boost signal and by the operating parameter signal; and in which the base boost signal is determined by the engine speed signal.

22. An internal combustion engine fuel system comprising:

electrically-controlled, hydraulically-activated fuel injectors for injecting fuel into engine cylinders;

an electric control for causing hydraulic activation of the fuel injectors to inject fuel into the cylinders;

the electric control comprising an injection signal source supplying injection signals to the fuel injectors to cause the fuel injectors to be hydraulically activated;

the electric control further comprising a commanded boost signal source supplying commanded boost signals; and the electric control further comprising an interface for superimposing the commanded boost signals on the injection signals during phases of the injection signals;

in which the commanded boost signal source comprises an adjusted boost signal source supplying adjusted boost signals;

in which the adjusted boost signal source comprises a base boost signal source supplying base boost signals representing boost for the injection signals and an operating parameter signal source supplying an operating parameter signal correlated to a variable engine operating parameter;

in which the adjusted boost signals are determined both by the base boost signals and by the operating parameter signal; and in which the commanded boost signals are determined by the adjusted boost signals.

23. An internal combustion engine fuel system as set forth in claim 22 in which the operating parameter signal source supplying an operating parameter signal correlated to a variable engine operating parameter comprises a temperature source supplying a temperature signal corresponding to a temperature related to engine operation, and the adjusted boost signals are determined both by the base boost signals and by the temperature signal.

24. An internal combustion engine fuel system as set forth in claim 23 in which change in the temperature signal representing certain temperature increase causes decreases in the durations for which the commanded boost signals are superimposed on the injection signals.

25. An internal combustion engine fuel system as set forth in claim 22 in which the base boost signal source comprises a fuel delivery control signal source supplying fuel delivery control signals correlated to amounts of fuel to be injected by the fuel injectors during fuel injections, and in which the base boost signals are determined by the fuel delivery control signals.

26. An internal combustion engine fuel system as set forth in claim 22 in which the base boost signal source comprises an engine speed signal source supplying a speed signal correlated to engine speed, and in which the base boost signal is determined by the speed signal.

27. An internal combustion engine fuel system as set forth in claim 22 in which the commanded boost signal source further includes a requested boost signal source supplying requested boost signals and a comparator that selects the smaller-valued one of each adjusted boost signal and requested boost signals applied to the comparator to be a respective commanded boost signal for a fuel injector.

28. An internal combustion engine fuel system as set forth in claim 26 including a hydraulic pressure fluid source that delivers hydraulic pressure to the fuel injectors to cause fuel injections, in which the requested boost signal source comprises an injection control pressure source supplying an injection control pressure signal correlated to hydraulic pressure delivered to the fuel injectors from the hydraulic pressure fluid source, and in which the requested boost signals are determined by the injection pressure control signal.

29. A method of operating an internal combustion engine fuel injector comprising:

creating, in an electric control, a fuel injection signal providing electric power flow to a fuel injector;

supplying a commanded boost signal;

superimposing the commanded boost signal on the fuel injection signal during a phase of the injection signal to augment the electric power flow to the fuel injector;

and attenuating the duration of the commanded boost signal as a function of a variable parameter that is indicative of decreased tolerance of the electric control to increased electric power flow to the fuel injector.

* * * * *